US006737612B2

(12) United States Patent
Taniguchi et al.

(10) Patent No.: US 6,737,612 B2
(45) Date of Patent: May 18, 2004

(54) CERAMIC HEATER AND GLOW PLUG HAVING THE CERAMIC HEATER

(75) Inventors: Masato Taniguchi, Aichi (JP); Fumihiko Haraguchi, Nagoya (JP)

(73) Assignee: NGK Spark Plug Co., Ltd., Aichi (JP)

( * ) Notice: Subject to any disclaimer, the term of this patent is extended or adjusted under 35 U.S.C. 154(b) by 2 days.

(21) Appl. No.: 10/208,797

(22) Filed: Aug. 1, 2002

(65) Prior Publication Data

US 2003/0042243 A1 Mar. 6, 2003

(30) Foreign Application Priority Data

Aug. 28, 2001 (JP) ..... 2001-258302

(51) Int. Cl.[7] ..... F23Q 7/00
(52) U.S. Cl. ..... 219/270; 219/541; 123/145 A
(58) Field of Search ..... 219/270, 544, 219/541, 267; 123/145 A, 145 R

(56) References Cited

U.S. PATENT DOCUMENTS 4,418,661 A * 12/1983 Esper et al. ..... 123/145 A
4,633,064 A * 12/1986 Atsumi et al. ..... 219/270
5,362,944 A * 11/1994 Hatanaka et al. ..... 219/270
5,883,360 A * 3/1999 Tatematsu et al. ..... 219/270
2002/0170903 A1 * 11/2002 Taniguchi et al. ..... 219/270

FOREIGN PATENT DOCUMENTS

| | | | |
|---|---|---|---|
| JP | 62-141423 | | 6/1987 |
| JP | 63-91432 | * | 4/1988 |
| JP | 4-268112 | | 9/1992 |
| JP | 10-89228 | * | 4/1998 |

* cited by examiner

*Primary Examiner*—John A. Jeffery
(74) *Attorney, Agent, or Firm*—Sughrue Mion, PLLC

(57) ABSTRACT

A ceramic heater includes a rod-shaped heater body provided with an insulating ceramic substrate, a heating resistor embedded in a front end portion of the ceramic substrate and a pair of first and second electric conductors embedded in the ceramic substrate with front end portions thereof electrically connected to the heating resistor and rear end portions thereof exposed at a rear end surface of the heater body. The ceramic heater further includes first and second lead-out members having front surfaces joined to parts of the rear end surface of the heater body via metallic layers so as to cover the exposed rear end portions of the first and second electric conductors, respectively, and to be kept from covering an outer circumferential surface of the heater body.

15 Claims, 8 Drawing Sheets

CERAMIC HEATER AND GLOW PLUG HAVING THE CERAMIC HEATER

BACKGROUND OF THE INVENTION

The present invention relates to a ceramic heater and a glow plug having the ceramic heater.

Hereinafter, the term "front" refers to a heating end side with respect to the axial direction of a rod-shaped ceramic heater, and the term "rear" refers to a side opposite the front side.

A glow plug is widely used, which comprises a cylindrical metallic shell, a rod-shaped ceramic heater disposed in the metallic shell with a front end portion thereof protruded from the metallic shell, a central electrode partly disposed in a rear portion of the metallic shell and connected to power source, and a metallic lead through which the ceramic heater and the central electrode are electrically connected to each other. In such a structure, the ceramic heater is externally energized through the central electrode and the lead.

Conventionally, the ceramic heater and the lead are connected to each other by the following methods (1) to (3):

(1) a front end portion of the lead is coiled, and a heater terminal exposed at a rear end of the ceramic heater is inserted into and brazed to the coiled front end portion of the lead, as disclosed in Japanese Laid-Open Patent Publication No. 10-205753;

(2) a metallic connecting cap is brazed to a rear end of the ceramic heater so that the connecting cap covers both of a rear end surface and an outer circumferential surface of the ceramic heater, and a front end portion of the lead is brazed to the connecting cap, as disclosed in Japanese Laid-Open Patent Publication Nos. 4-268112 and 62-141423 and Japanese Patent Publication No. 60-30608; and (3) a front end portion of the lead is embedded in a rear end of the ceramic heater, as disclosed in Japanese Laid-Open Patent Publication No. 2000-356343.

However, there are some problems in the above conventional methods (1) to (3).

It has been increasingly demanded to make the glow plug compact in size in order to provide a multivalve diesel engine and to achieve weight reductions of engine parts. In the method (1), however, the coiled end portion of the lead takes up radial space around the rear end of the ceramic heater. Thus, such a demand cannot be always satisfied because of the radial space for the coiled end portion of the lead, even when the diameter of the ceramic heater is made smaller. Further, there arises the possibility of a short circuit upon placement of the coiled end portion of the lead in a very small clearance between the metallic shell and the ceramic heater. The demand to make the glow plug compact in size cannot be always satisfied either in the method (2), because the connecting cap takes up radial space around the ceramic heater. In addition, the ceramic heater is strongly acted upon by a thermal stress through the connecting cap, whereby the ceramic heater tends to become cracked. In the method (3), the front end portion of the lead has to be formed as a sintered member separately, thereby resulting in much expenses in time and effort for production. Further, the joint surface between the ceramic heater and the lead tends to be insufficient to attain a good joint strength.

SUMMARY OF THE INVENTION

It is therefore an object of the present invention to provide a ceramic heater which can be produced easily and, when applied to a glow plug, can reduce the risk of a short-circuit and maintain a proper joint between the ceramic heater and the lead in repeated cycles of heating and cooling while allowing the glow plug to become compact in size.

It is also an object of the present invention to provide a glow plug using such a ceramic heater.

According to a first aspect of the present invention, there is provided a ceramic heater comprising: a rod-shaped heater body having an insulating ceramic substrate, a heating resistor embedded in a front end portion of the ceramic substrate and an electric conductor embedded in the ceramic substrate with a front end portion thereof electrically connected to the heating resistor and a rear end portion thereof exposed at a rear end surface of the heater body; and a lead-out member having a front surface joined to part of the rear end surface of the heater body via a metallic layer so as to cover the exposed rear end portion of the electric conductor and to be kept from covering an outer circumferential surface of the heater body.

According to a second aspect of the present invention, there is provided a glow plug comprising: a ceramic heater provided with a rod-shaped heater body and a lead-out member, the heater body having an insulating ceramic substrate, a heating resistor embedded in a front end portion of the ceramic substrate and an electric conductor embedded in the ceramic substrate with a front end portion thereof electrically connected to the heating resistor and a rear end portion thereof exposed at a rear end surface of the heater body, the lead-out member having a front surface joined to part of the rear end surface of the heater body via a metallic layer so as to cover the exposed rear end portion of the electric conductor and to be kept from covering an outer circumferential surface of the heater body; a metallic sleeve circumferentially surrounding the heater body with a front end portion of the heater body protruded from the metallic sleeve; and a metallic shell fitted onto a rear end portion of the metallic sleeve and having a mounting portion on an outer circumferential surface thereof so as to mount the glow plug in a cylinder head.

According to a third aspect of the present invention, there is a ceramic heater comprising: a rod-shaped heater body having an insulating ceramic substrate, a heating resistor embedded in a front end portion of the ceramic substrate, and a pair of first and second electric conductors embedded in the ceramic substrate with front end portions thereof electrically connected to the heating resistor and rear end portions thereof exposed at a rear end surface of the heater body; and first and second lead-out members having front surfaces joined to parts of the rear end surface of the heater body via metallic layers so as to cover the exposed rear end portions of the first and second electric conductors, respectively, and to be kept from covering an outer circumferential surface of the heater body.

According to a fourth aspect of the present invention, there is provided a glow plug comprising: a ceramic heater provided with a rod-shaped heater body and a pair of first and second lead-out members, the heater body having an insulating ceramic substrate, a heating resistor embedded in a front end portion of the ceramic substrate, and a pair of first and second electric conductors embedded in the ceramic substrate with front end portions thereof electrically connected to the heating resistor and rear end portions thereof exposed at a rear end surface of the heater body, the first and second lead-out members having front surfaces joined to parts of the rear end surface of the heater body via metallic layers so as to cover the exposed rear end portions of the first and second electric conductors, respectively, and to be kept from covering an outer circumferential surface of the heater body; a metallic sleeve circumferentially surrounding the heater body with a front end portion of the heater body protruded from the metallic sleeve; and a metallic shell fitted onto a rear end portion of the metallic sleeve and having a mounting portion on an outer circumferential surface thereof so as to mount the glow plug in a cylinder head.

DESCRIPTION OF THE EMBODIMENTS

Figure 1:
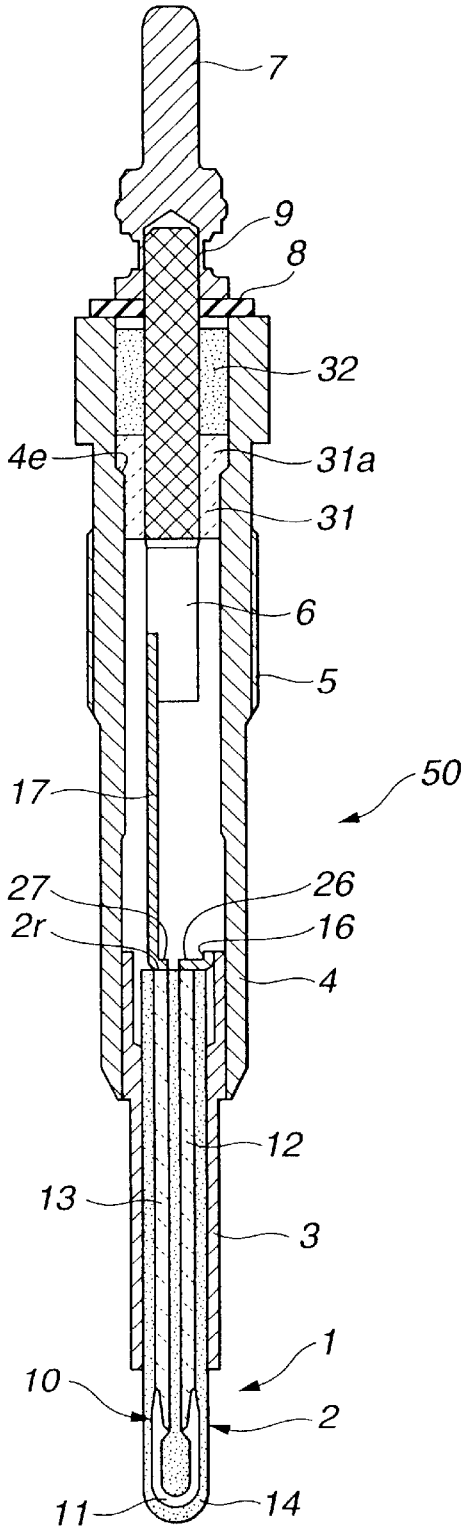
FIG. 1 is a sectional view of a glow plug according to a first embodiment of the present invention.

An explanation will be given of a ceramic heater and a glow plug having the ceramic heater according to the present invention by way of preferred embodiments. Like parts and portions in the following embodiments are designated by like reference numerals, and repeated descriptions thereof are omitted.

Firstly, a glow plug 50 according to a first embodiment of the present invention will be described with reference to FIGS. 1, 2A, 2B, 3 and 4.

Figure 2A:
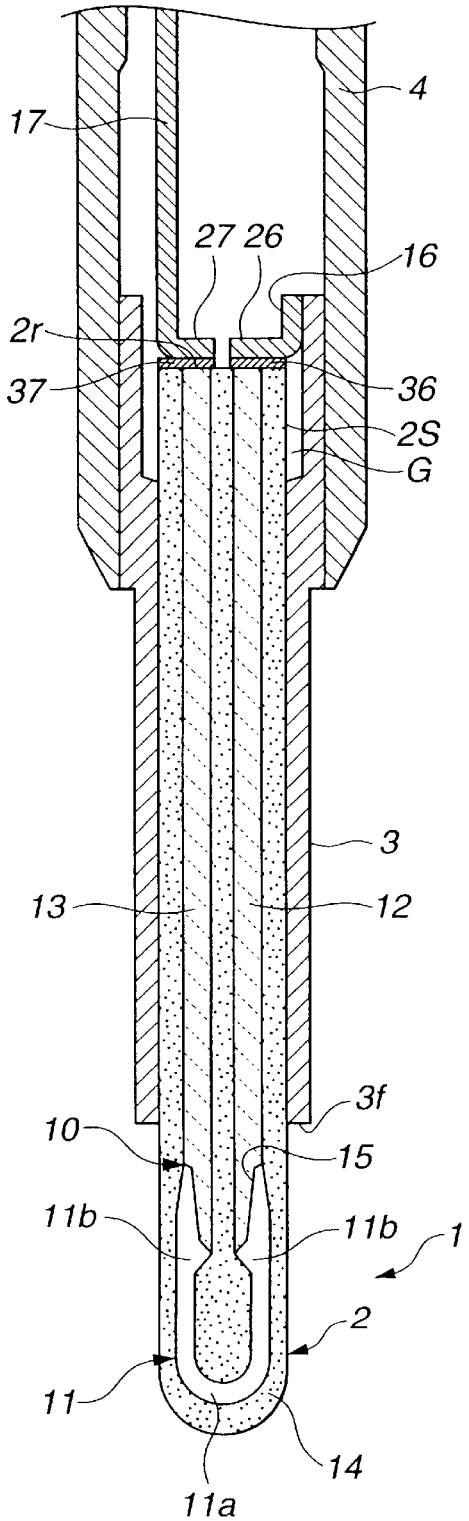
FIG. 2A is a sectional view illustrating a front portion of the glow plug of FIG. 1.
Figure 2B:
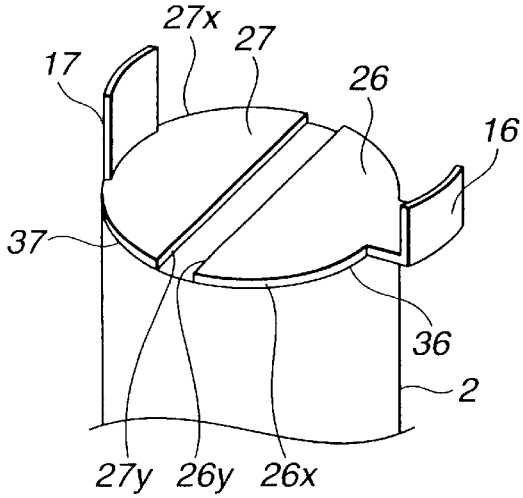
FIG. 2B is an enlarged perspective view of a rear end portion of a ceramic heater according to the first embodiment of the present invention.

Referring to FIGS. 1, 2A and 2B, the glow plug 50 has a ceramic heater 1, a metallic sleeve 3 circumferentially surrounding the ceramic heater 1 with a front end portion of the ceramic heater 1 protruded from the metallic sleeve 3, a metallic shell 4 retaining therein a rear end portion of the metallic sleeve 3, a central electrode 6 partly inserted in a rear portion of the metallic shell 4, and leads 16 and 17 for electrically connecting the ceramic heater 1 to the metallic sleeve 3 and the central electrode 6, respectively. A threaded mounting portion 5 is formed on an outer circumferential surface of the metallic shell 4 so as to mount the glow plug 1 in a cylinder head (not shown).

The metallic shell 4 is fixed on the metallic shell 3 by brazing (i.e., filling a space between an inner circumferential surface of the metallic shell 4 and an outer circumferential surface of the metallic sleeve 3 with a brazing filler) or by laser welding an inner front edge of the metallic shell 4 to the outer circumferential surface of the metallic sleeve 3.

As shown in FIG. 2A, the ceramic heater 1 is disposed in the metallic sleeve 3 so that a rear end surface 2*r* of the heater body 2 is located inside of the metallic sleeve 3 in the first embodiment. Further, a rear end portion of the metallic sleeve 3 is radially protruded so as to make the inside diameter of the rear end portion of the metallic sleeve 3 larger and thereby provide a clearance G between an outer circumferential surface 2*s* of the heater body 2 and an inner circumferential surface of the rear end portion of the metallic sleeve 3.

The ceramic heater 1 has a rod-shaped heater body 2 provided with a ceramic substrate 14 and a heating unit 10. The heating unit 10 includes a U-shaped heating resistor 11 embedded in a front end portion of the ceramic substrate 14 and a pair of rod-shaped electric conductors 12 and 13 embedded in the ceramic substrate 14 on the rear side of the heating resistor 11. The U-shaped heating resistor 11 has a front end portion 11*a* (i.e. the bottom of U) and rear end portions 11*b* formed with joint faces 15. The front end portion 11*a* is made smaller in diameter than the rear end portions 11*b* so that supply current becomes concentrated at the front end portion 11*a* to heat the front end portion 11*a* to the highest temperature in a state of working. The electric conductors 12 and 13 are generally in parallel along an axis of the glow plug 50, and have front end portions connected to the respective joint faces 15 of the heating resistor 11 and rear end portions exposed at the rear end surface 2*r* of the heater body 2.

The ceramic heater 1 further comprises first and second lead-out members 26 and 27 for electrically connecting the exposed rear end portions of the electric conductors 12 and 13 to the leads 16 and 17, respectively. The first and second lead-out members 26 and 27 are joined to parts of the rear end surface 2*r* of the heater body 2 via metallic layers 36 and 37 so as to cover the rear end portions of the conductors 12 and 13, respectively, but not cover the outer circumferential surface 2*s* of the heater body 2. The first and second lead-out members 26 and 27 are insulated from each other. That is, there is no need to provide extra radial space for the first and second lead-out members 26 and 27 so that the glow plug 50 can be made compact in size especially when making the diameter of the heater body 2 smaller. Further, the heater body 2 can be effectively prevented from becoming cracked and split without the outer circumferential surface 2*s* being intensely acted upon by a large thermal stress even when the glow plug 50 is heated and cooled in cycles.

Further, each of the first and second lead-out members 26 and 27 is formed into a plate. Thus, the first lead-out member 26 has a front surface connected via the metallic layer 36 with the rear end surface 2*r* of the heater body 2 including an exposed surface of the rear end portion of the conductor 12, while the second lead-out member 27 has a front surface connected via the metallic layer 37 with the rear end surface 2*r* of the heater body 2 including an exposed surface of the rear end portion of the conductor 13. This makes it possible to secure larger joint surfaces between the heater body 2 and each of the first and second lead-out members 26 and 27, between the electric conductor 12 and the first lead-out member 26 and between the electric conductor 13 and the second lead-out member 27 and thereby increase joint strengths therebetween. In addition, the first and second lead-out members 26 and 27 can be easily joined to the rear end surface 2*r* of the heater body 2 by brazing in such a structure, and much expense in time and effort is not needed to provide the first and second lead-out members 26 and 27.

More specifically, the first and second lead-out members 26 and 27 are generally semi-circular, being defined by circular edges 26*x* and 27*x* and linear edges 26*y* and 27*y*, respectively, in the first embodiment. The first and second lead-out members 26 and 27 are disposed oppositely to each other so as to provide a predetermined spacing between the linear edges 26*y* and 27*y*.

In order to establish a proper insulation between the first and second lead-out members 26 and 27, the spacing is preferably more than or equal to 0.1 mm. Further, the spacing is preferably less than or equal to 1.0 mm in terms of the miniaturization of the glow plug 50. In the first embodiment, the spacing is 0.5 mm.

In the first embodiment, the leads 16 and 17 are formed integrally with the first and second lead-out members 26 and 27, respectively, so as to reduce the number of parts. The lead 16 and the first lead-out member 26 are formed into one piece so that the lead 16 extends radially from the circular edge 26*x* of the first lead-out member 26 to cross over the clearance G, and an end portion of the lead 16 is bent axially toward the rear and joined to the inner circumferential surface of the rear end portion of the metallic sleeve 3 by e.g. resistance welding. The lead 17 and the second lead-out member 27 are also formed into one piece so that the lead 17 extends axially from the circular edge 27*x* of the second lead-out member 27, and an rear end portion of the lead 17 is joined to a front end portion of the central electrode 6 by e.g. resistance welding.

In the presence of the clearance G, it becomes easier to make an electrical connection between the heater body 2 and the metallic sleeve 3 by joining the first lead-out member 26 and the lead 16 thereto and possible to avoid a short circuit upon contact between the lead 17 and the metallic sleeve 3. The clearance G is preferably more than or equal to 0.1 mm so that the first lead-out member 26 and the lead 15 can be easily joined to the heater body 2 and the metallic sleeve 3, respectively, and that the lead 17 and the metallic sleeve 3 are assuredly insulated from each other. Also, the clearance G is preferably less than or equal to 1.0 mm in order to make the glow plug 50 compact in size. In the first embodiment, the clearance G is 0.5 mm.

In the heater body 2, the ceramic substrate 14 is made of ceramic with an insulation property, and the heating resistor 11 and the electric conductors 12 and 13 are made of ceramic having electrical conductivity. As the entire heater body 2 is made of ceramic, it can be produced with less expenses in time and effort.

The ceramic for the ceramic substrate 14 can be any insulating ceramic material. In the first embodiment, silicon nitride ceramic is used. The silicon nitride ceramic generally contains grains predominantly made of silicon nitride ($Si_3N_4$) bonded to each other through grain boundary resulting from a sintering aid. The silicon nitride may contain Al and O with which some of Si and N are substituted, respectively. The grains may contain a metal atom or atoms, such as Li, Ca, Mg and/or Y, in the silicon nitride as a solid solution. The sintering aid includes a cationic element or elements selected from Groups 3A, 4A, 5A, 3B (e.g. Al) and 4B (e.g. Si) of the Periodic Table and Mg. The above cationic element and elements are added in the form of oxide, and contained in the form of oxide or compound oxide (such as silicate) in the sintered silicon nitride ceramic. The amount of the sintering aid is from 1 to 10% by weight in terms of oxide based on the total weight of the sintered silicon nitride ceramic. When the amount of the sintering aid is less than 1% by weight, the ceramic material cannot be close-grained when sintered. On the other hand, when the amount of the sintering aid is more than 10% by weight, the obtained ceramic material cannot attain a sufficient strength, toughness and/or heat resistance. Preferably, the amount of the sintering aid is from 2 to 8% by weight. In the case whether the sintering aid includes rare-earth element or elements, there may be selected from Sc, Y, La, Ce, Pr, Nd, Sm, Eu, Gd, Tb, Dy, Ho, Er, Tm, Yb and Lu. Among these elements, preferred are Tb, Dy, Ho, Er, Tm and Yb because they provide effects of promoting the crystallization of grain boundary and improving high-temperature strength of grain boundary.

The ceramic for the heating resistor 11 (hereinafter referred to as "first ceramic") has a higher electrical resistance than the ceramic for the conductors 12 and 13 (referred to as "second ceramic"). The method for providing the first and second ceramic with different electrical resistances is not particularly restricted. For example, there may be used:

(1) the method in which the same kind of conductive ceramic material is contained in the first and second ceramic with different contents thereof;

(2) the method in which different kinds of conductive ceramic materials having distinct electrical resistances are contained in the first and second ceramic, respectively; or (3) the method in which the same and different kinds of conductive ceramic materials are contained in the first and second ceramic in combination. In the first embodiment, the method (1) is used. The conductive ceramic material can be e.g. tungsten carbide (WC), siliconized molybdenum ($MoSi_2$) and siliconized tungsten ($WSi_2$). In the first embodiment, tungsten carbide is used.

In order to reduce differences in coefficients of linear expansion between the heating resistor 11 and the ceramic substrate 14 and between the electric conductors 12 and 13 and the ceramic substrate 14 and thereby increase heat and impact resistance, the same insulating ceramic material as used for the ceramic substrate 14 (in the embodiment, silicon nitride ceramic) can be added to the first and second ceramic.

The electrical resistances of the first and second ceramic can be adjusted depending on the contents of the insulating ceramic material and of the conductive ceramic material. More specifically, the first ceramic for the heating resistor 11 comprises 10 to 25% by volume of the conductive ceramic material and the balance being the insulating ceramic material. When the amount of the conductive ceramic material is more than 25% by volume, the conductivity of the first ceramic becomes too high so that the heating resistor 11 cannot generate sufficient heat. When the amount of the conductive ceramic material is less than 10% by volume, the conductivity of the first ceramic becomes too low so that the heating resistor 11 cannot generate sufficient heat. Further, the second ceramic for the conductors 12 and 13 comprises 15 to 30% by volume of the conductive ceramic material and the balance being the insulating ceramic material. When the amount of the conductive ceramic material is more than 30% by volume, the second ceramic cannot be close-grained when sintered and therefore does not have sufficient strength. In addition, the electrical resistance of the second ceramic does not rise sufficiently even when heated to a normal working temperature for the preheating of an engine, thereby failing to perform a self-control function to stabilize its current density. When the amount of the conductive ceramic material is less than 15% by volume, the electric conductors 12 and 13 generate heat, thereby deteriorating heat-generating efficiency of the heating resistor 11. In the first embodiment, the first ceramic comprises 16% by volume (55% by weight) of tungsten carbide and the balance being silicon nitride ceramic, and the second ceramic comprises 20% by volume (70% by weight) of tungsten carbide and the balance being silicon nitride ceramic.

Figure 4:
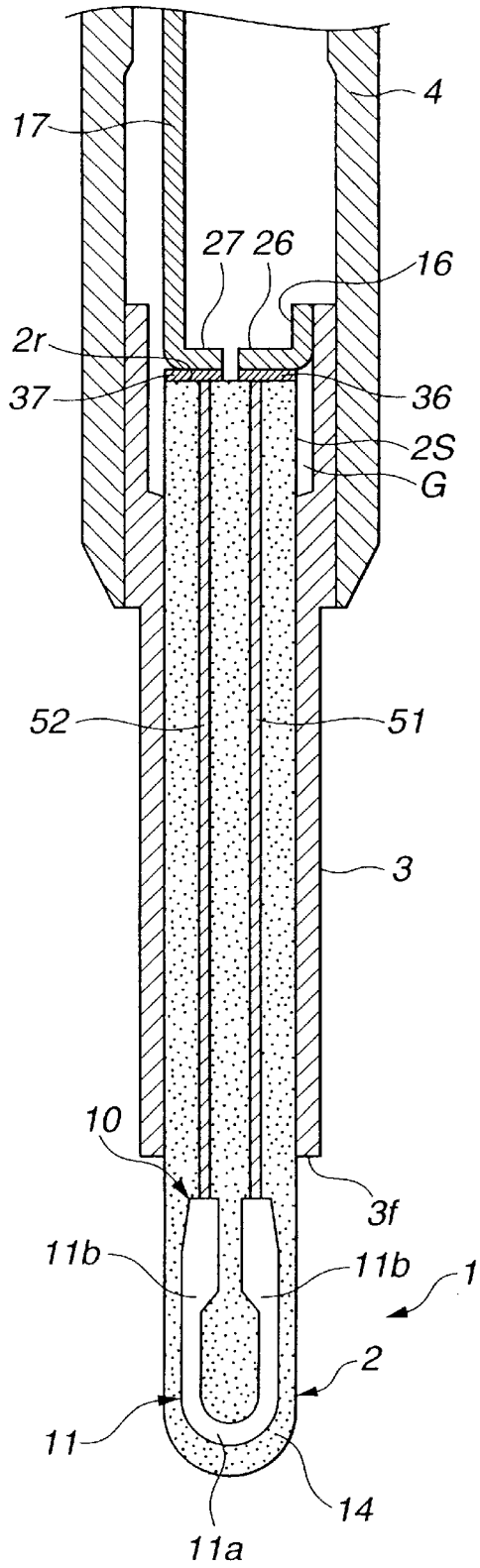
FIG. 4 is a sectional view illustrating a front portion of a glow plug according to a modification of the first embodiment.
Figure 5:
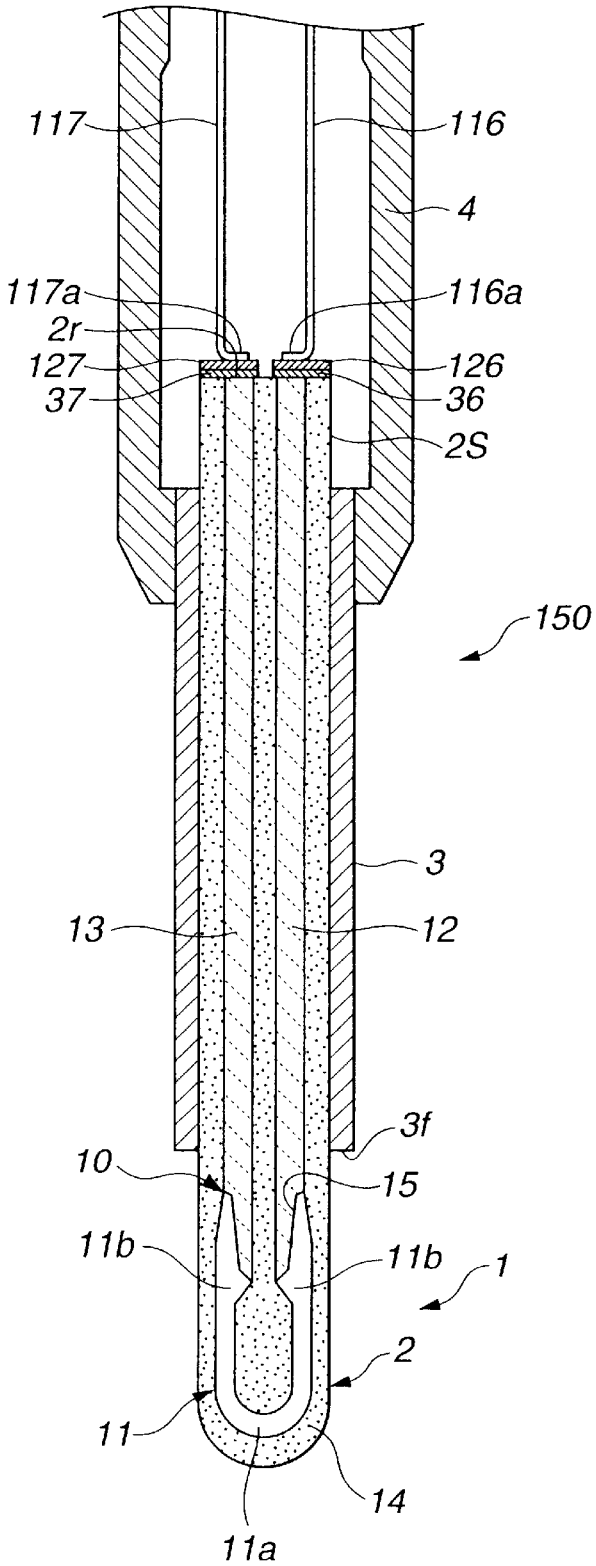
FIG. 5 is a sectional view illustrating a front portion of a glow plug according to a second embodiment of the present invention.

A pair of electric conductors 51 and 52 formed as lead wires of high-melting metal (such as tungsten or the like) may be employed in place of the ceramic conductors 12 and 13, as shown in FIG. 4. However, there arises a possibility of electromigration by which the metal atoms of the conductors 51 and 52 are diffused under the electrochemical force resulting from field gradients. The effect of electromigration can be substantially avoided by the use of the ceramic conductors 12 and 13.

The first and second lead-out members 26 and 27 are joined to the rear end surface 2*r* of the heater body 2 via the metallic layers 36 and 37, respectively, as described above. Such metallic layers 36 and 37 can be formed by brazing with an activated brazing material containing therein an active metal component, or by metallizing the heater body 2 by evaporation of an active metal component and then brazing with normal brazing materials. The brazing material can be any conventional Ag- or Cu-based brazing material, and the active metal component may includes at least one of Ti, Zr and Hf. For example, a Cu-based activated brazing material comprising 5% by weight of Si, 3% by weight of Pd, 2% by weight of Ti and the balance being Cu may be used for the metallic layers 36 and 37. The metallic layers 36 and 37 are preferably formed by screen printing, so that the metallic layers 36 and 37 can be at proper positions on the rear end surface 2*r* of the heater body 2 while being prevented from hanging over the outer circumferential surface 2*s* of the heater body 2.

Figure 3:
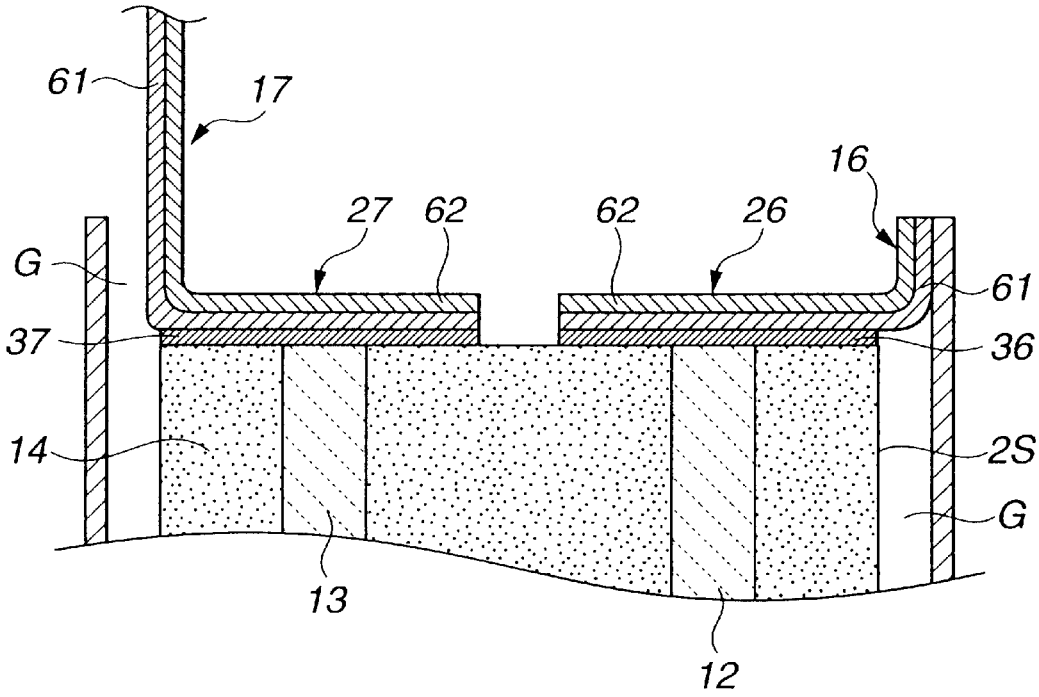
FIG. 3 is a sectional view of lead-out members of the ceramic heater according to the first embodiment of the present invention.

In the ceramic-metal joint, there is a great difference in coefficients of linear expansion between the heater body 2 and the metallic layers 36 and 37. As a result, the ceramic-metal joint between the heater body 2 and the metallic layers 36 and 37 is liable to be acted upon by a large thermal stress when the joint is cooled after formed by brazing and when the joint is heated and cooled in cycles through the use of the glow plug 50. In order to absorb such a thermal stress and increase durability of the ceramic-metal joint, the first and second lead-out members 26 and 27 may have low-expansion metal layers 62 formed at least in parts of rear surfaces thereof so as to radially correspond in position to the metallic layers 36 and 37, while the front surfaces thereof are kept in contact with the metallic layers 36 and 37, respectively, as shown in FIG. 3. For convenience of production, the first lead-out member 26 and the lead 16 are formed into one piece of a clad material having the low-expansion metal layer 62, and the second lead-out member 27 and the lead 17 are formed into one piece of a clad material having the low-expansion metal layer 62 in the first embodiment.

The low-expansion metal layers 62 are made of a metal having a lower coefficient of expansion than that of the brazing material for the metallic layers 36 and 37, so as to provide the effects of limiting substantial expansion and contraction of the metallic layers 36 and 37 and absorbing the thermal stress exerted on the ceramic-metal joint between the heater body 2 and the metallic layers 36 and 37. This makes it possible to increase the durability of the ceramic-metal joint. More specifically, the low-expansion metal layer 62 can be made of a Fe-based low-expansion metal having an average coefficient of linear expansion lower than or equal to $2.0\times10^{-6}$/° C. at 100 to 200° C. Specific examples of such a low-expansion metal include Fe alloys (with a Fe content of 40% by weight or more) having very small coefficients of expansion under so-called Invar effect. Invar effect is a phenomenon in which, when ferromagnetism (including antiferromagnetism) occurs at room temperature to cause the expansion of a material, such expansion cancels out volume change resulting from lattice vibration so that the coefficient of linear expansion of the material is made small. The Fe alloy remarkably exhibits such an effect when containing specific contents of Ni, Co, Pd and/or Pt as alloy elements. Preferably, at least one of Ni and Co is contained in view of cost reduction. There may be added another element (e.g. Cr, Si or C) in order to improve mechanical properties, such as corrosion resistance, strength and workability as long as the alloy attains a required coefficient of linear expansion. The alloy may not exhibit a low coefficient of linear expansion when the first and second lead-out members 26 and 27 are at the highest temperature (e.g. 700 to 900° C.) in a state of working, but always has a very small coefficient of linear expansion at a temperature lower than or equal to a magnetic transformation point thereof. When the alloy exhibits thermal hysteresis, displacements of the low-expansion metal layer 62 between its expansion state and contract state can be made smaller. Thus, the use of such an alloy is effective in preventing the cracking and separation of the ceramic-metal joint especially when the joint is cooled after formed by brazing. In order to attain such an effect, an alloy having a higher magnetic transformation point (e.g. 60° C. or higher) is preferably used. As the above-mentioned Fe-based alloy, there are exemplified by:

Invar (containing 36.5 wt % Ni with the balance of Fe, $\alpha=1.2\times10^{-6}$/° C., Tc=232° C.);

Super Invar (containing 32 wt % Ni and 5 wt % Co with the balance of Fe, $\alpha=0.1\times10^{-6}$/° C., Tc=229° C.; Kovar (alloy containing 29 wt % Ni and 17 wt % Co with the balance of Fe);

Stainless Invar (containing 54 wt % Co and 9.5 wt % Cr with the balance of Fe, $\alpha=0.1\times10^{-6}$/° C., Tc=117° C.);

Nobinite (as a trade name for cast iron, containing 32 wt % Ni, 5 wt % Co, 2.4 wt % C and 2 wt % Si with the balance of Fe, $\alpha=1.8\times10^{-6}$/° C., Tc=300° C.); and Low-expansion alloy (abbreviated as LEX alloy, containing 36 wt % Ni, 0.8 wt % C and 0.6 wt % Si with the balance of Fe, $\alpha=1.9\times10^{-6}$/° C., Tc=250° C.), where $\alpha$ is an average coefficient of linear expansion in a temperature range from 100 to 200° C., and Tc is a Curie point (i.e. a magnetic transformation point).

Further, the first and second lead-out members 26 and 27 may have soft metal layers 61 formed in at least parts of the front surfaces thereof so as to be kept in contact with the metallic layers 36 and 37, as shown in FIG. 3. In the first embodiment, the soft metal layers 61 and the low-expansion metal layers 62 are clad with each other so as to take on a two-layered clad structure throughout the first and second lead-out members 26 and 27 and the leads 16 and 17.

The soft metal layers 61 are made of a metal softer than the metal for the low-expansion metal layers 62, such as Cu or Cu alloy. Even when the metallic layers 36 and 37 are displaced relative to the heater body 2 due to the difference in coefficients of linear expansion therebetween, the soft metal layers 61 get plastically deformed. This makes it possible to absorb the thermal stress exerted on the ceramic-metal joint and thereby prevent the separation of the metallic layers 36 and 37 from the heater body 2.

Referring again to FIG. 1, the central electrode 6 is disposed in the metallic shell 4 with a ceramic ring 31 interposed between the inner circumferential surface of the metallic shell 4 and the outer circumferential surface of the rear end portion of the central electrode 6, whereby an electrical insulation between the metallic shell 4 and the central electrode 6 can be maintained. A protruded head portion 31*a* is formed on the outer circumferential surface of the ceramic ring 31, and retained by a stepped portion 4*e* of the metallic shell 4 so that the ceramic ring 31 does not slip off from the front side. Further, a glass seal layer 32 is formed so as to hold the ceramic ring 31 from the rear side. An outer circumferential portion of the central electrode 6 (the shaded portion of FIG. 1) which contacts with the glass seal member 32 is roughened by e.g. knurl processing. A rear end portion of the central electrode 6 is protruded from the metallic shell 4, and a metallic terminal member 7 is fit onto the protruded end portion of the central electrode 6 with an insulating bushing 8 retained by a rear end face of the metallic shell 4, and then, connected to a battery (not shown). The terminal member 7 is fixed to the central electrode 6 by caulking at a caulked portion 9 so as to make an electrical connection between the central electrode 6 and the terminal member 7.

In the application of the above-described glow plug 50 to a diesel engine, the glow plug 50 is mounted in the cylinder head of the engine by means of the threaded mounting portion 5 so that the front end portion (i.e. the heating end portion) of the heater body 2 is positioned in e.g. a swirl chamber (which is connected to a combustion chamber of the engine). When electric current is passed through the central electrode 6, the lead 17, the second lead-out member 27 and the heater body 2, the first lead-out member 26, the lead 16, the metallic sleeve 3, the metallic shell 4 and the cylinder head (and then to ground), the heating resister 11 of the heater body 2 generates heat for warming up the swirl chamber.

Next, a glow plug 150 according to a second embodiment of the present invention will be described with reference to FIGS. 5, 6A, 6B, 7 and 8. The second embodiment is similar in structure to the first embodiment, except that the ceramic heater 1 is grounded without passing through the metallic sleeve 3 and the metallic sleeve 4 and that leads 116 and 117 are formed separately from first and second lead-out members 126 and 127, respectively.

Figure 6A:
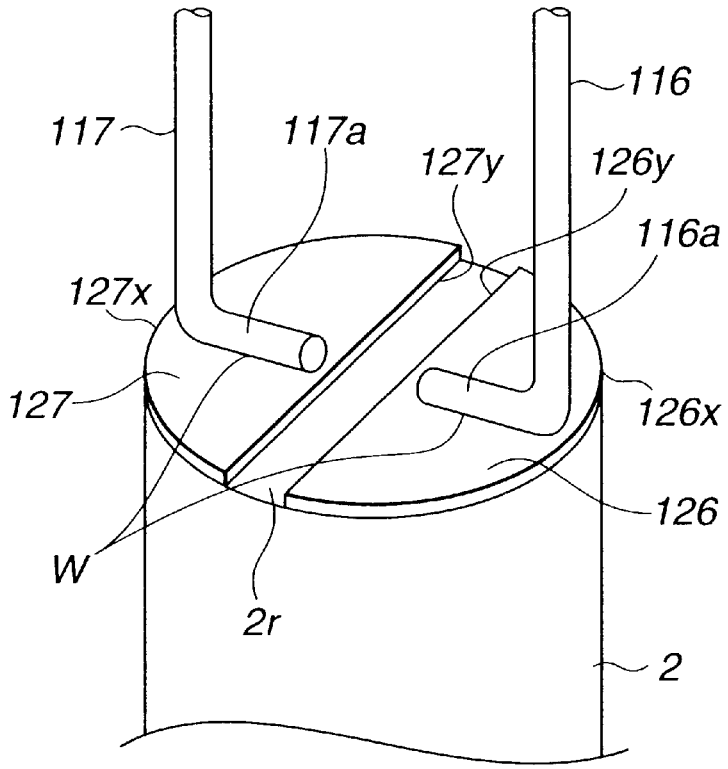
FIG. 6A is an enlarged perspective view of a rear end portion of a ceramic heater with lead-out members, to which leads are joined, according to the second embodiment of the present invention.

In the second embodiment, the ceramic heater 1 is disposed in the metallic sleeve 3 with both the front and rear end portions thereof protruded from the metallic sleeve 3. The first and second lead-out members 126 and 127 are plate-shaped and joined at front surfaces thereof to the rear end surface 2*r* of the heater body 2 via the metallic layers 36 and 37 so as to cover the exposed rear end portions of the electric conductors 12 and 13, respectively, but not to cover the outer circumferential surface 2*s* of the heater body 2. Further, front end portions 116*a* and 117*a* of the leads 116 and 117 are bent and joined to the rear surfaces of the first and second lead-out members 126 and 127 by e.g. resistance welding, as shown in FIG. 6A, in the second embodiment. The remaining portions of the leads 116 and 117 extend axially toward the rear and are joined at rear end portions thereof to terminal members (not shown in FIG. 5) fitted onto a rear end portion of the metallic shell 4. In such a structure, the heating resistor 11 of the heater body 2 is energized and grounded through the terminal members, the leads 116 and 117 and the first and second lead-out members 126 and 127, while the metallic shell 4 retains therein the ceramic heater 1 in a state of being insulated from the metallic shell 4. The first and second lead-out members 126 and 127 may be made of a clad material having the soft metal layer 61 and the low-expansion metal layer 62.

More specifically, the first and second lead-out members 126 and 127 are generally semi-circular, being defined by circular edges 126*x* and 127*x* and linear edges 126*y* and 127*y*, respectively. The first and second lead-out members 126 and 127 are disposed oppositely to each other so as to provide a predetermined spacing between the linear edges 126*y* and 127*y*. The front end portions 116*a* and 117*b* of the leads 116 and 117 are welded at sides thereof to the first and second lead-out members 126 and 127 so that the front end portions 116*a* and 117*b* are orthogonal to the linear edges 126*y* and 127*y*, respectively.

Figure 6B:
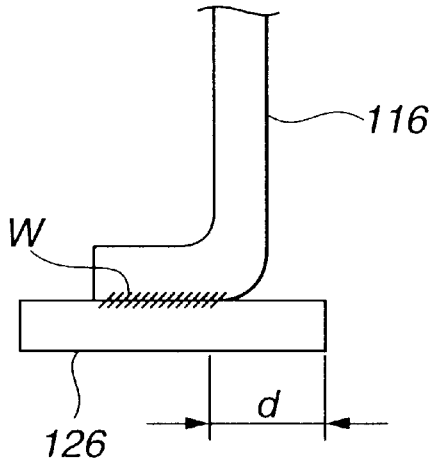
FIG. 6B is a side view of the joint between the lead-out member and the lead of FIG. 6B.

Herein, each of the first and second lead-out members 126 and 127 may not be brazed to the heater body 2 at a high strength even when the activated brazing material is used. If parts of the bent front end portions 116*a* and 117*a* of the leads 116 and 117 are protruded from the outer edges 126*x* and 126*y* of the first and second lead-out members 126 and 127, the tensions exerted on the leads 116 and 117 cause the front end portions 116*a* and 117*a* to peel the first and second lead-out members 126 and 127 gradually from the heater body 2. As a result, the first and second lead-out members 126 and 127 become likely to be separated from the heater body 2. In order to avoid such gradual separation, the front end portions 116*a* and 117*a* of the leads 116 and 117 are preferably joined to the first and second lead-out members 126 and 127 so that the front end portions 116*a* and 117*a* are entirely placed on the rear surfaces of the first and second lead-out members 126 and 127 as shown in FIG. 6B. More preferably, the front end portions 116*a* and 117*a* of the leads 116 and 117 are joined at welds W to the first and second lead-out members 126 and 127, respectively, so that the inside bends of the leads 116 and 117 are at the shortest distances d of 0.3 or more from the outer edges 126*x* and 127*x* of the lead-out members 126 and 127.

Figure 7:
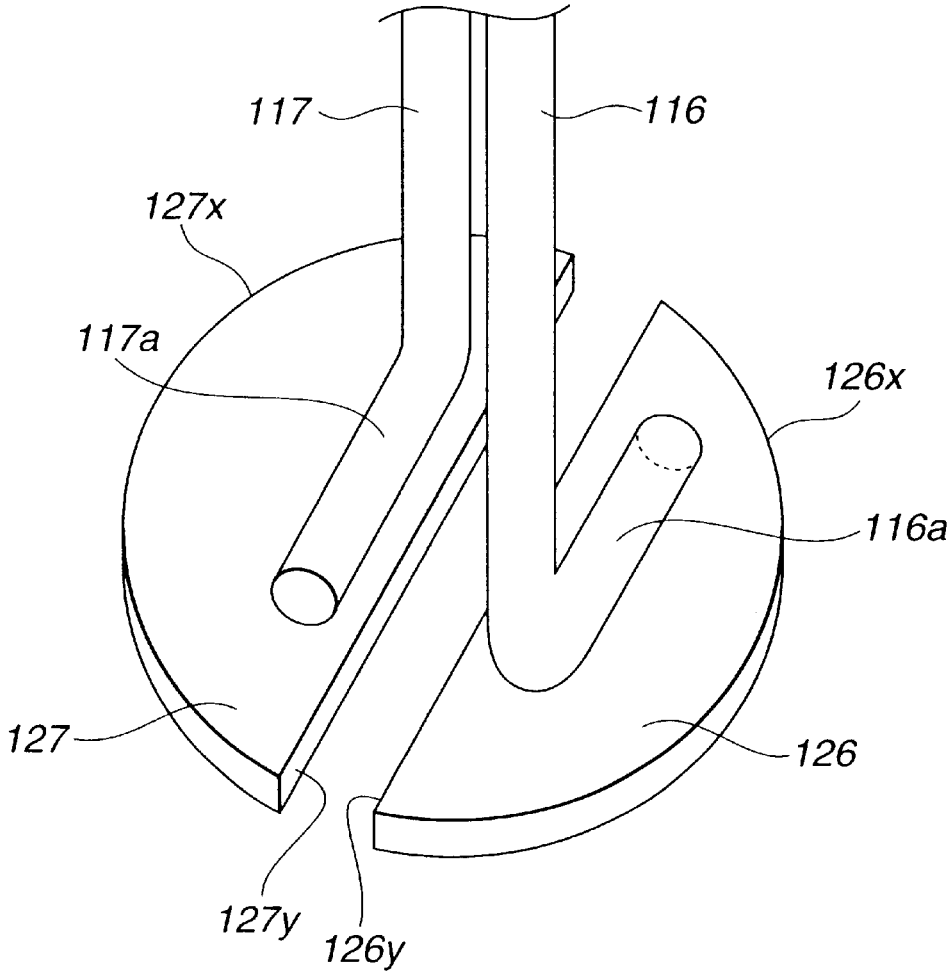
FIG. 7 is a perspective view illustrating a joint between a lead and a lead-out member of a ceramic heater according to a modification of the second embodiment.

Alternatively, the bent front end portions 116*a* and 117*a* of the leads 116 and 117 may be joined to the first and second lead-out members 126 and 127 so that the front end portions 116*a* and 117*a* are generally in parallel with the linear edges 126*y* and 127*y*, respectively, as shown in FIG. 7. This makes it possible to secure larger joint surfaces between the lead 116 and the first lead-out member 126 and between the lead 117 and the second lead-out member 127 and thereby possible to increase joint strengths therebetween.

Figure 8:
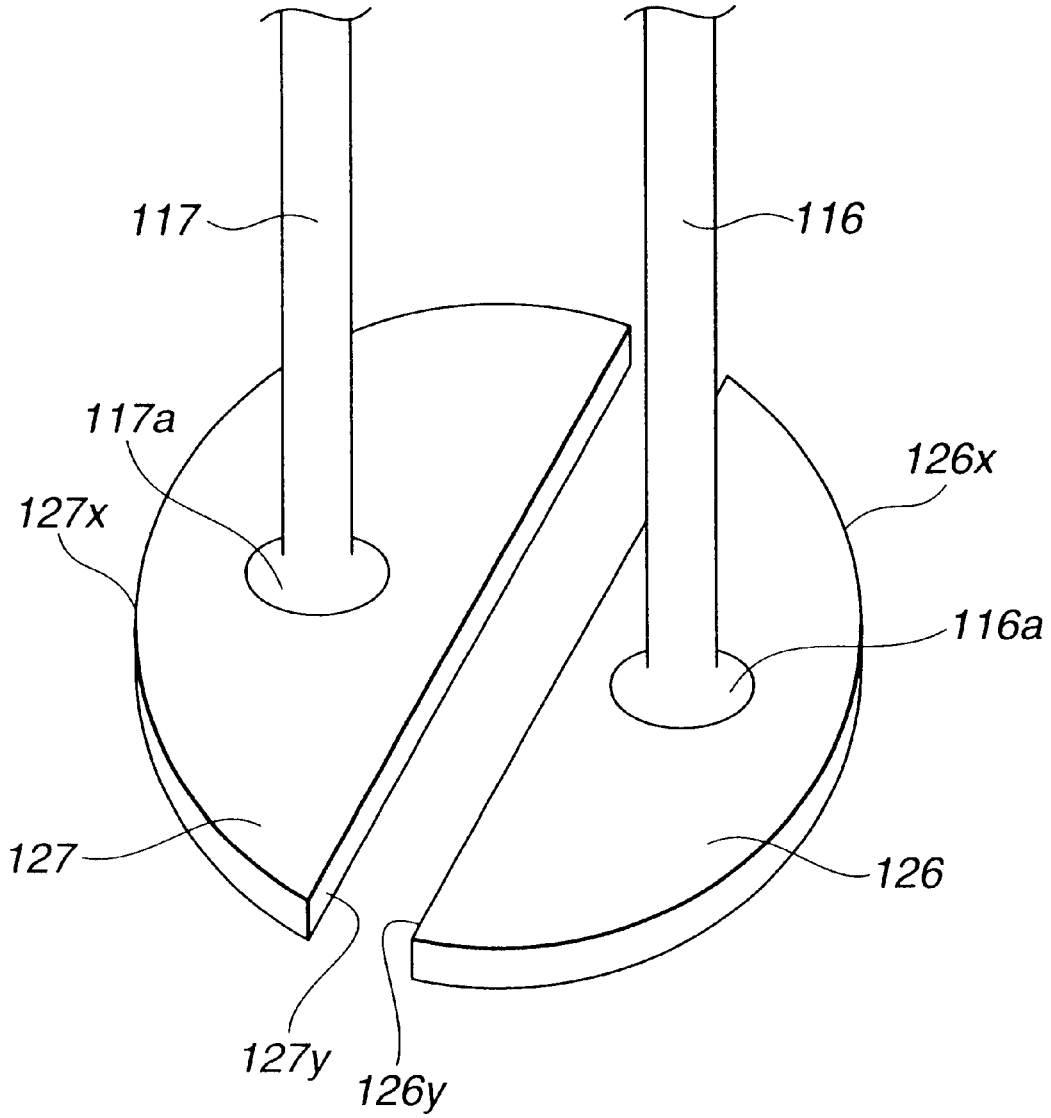
FIG. 8 is a perspective view illustrating a joint between a lead and a lead-out member of a ceramic heater according to another modification of the second embodiment.

Further, the front end portions 116*a* and 117*a* of the leads 116 and 117 may be joined without being bent. In such a case, the first end portions 116*a* and 117*a* of the leads 116 and 117 are preferably welded to the centers of the first and second lead-out members 126 and 127, respectively, as shown in FIG. 8, such that the first and second lead-out members 126 and 127 can be prevented from separating gradually from the rear end face 2*r* of the heater body 2.

The first and second lead-out members 126 and 127 may be formed into a single plate by e.g. punching. In such a case, the first and second lead-out members 126 and 127 are joined simultaneously to the heater body 2 in a state of being held together as a single plate. Then, the first and second lead-out members 126 and 127 are separated from each other by removing linking parts between the first and second lead-out members 126 and 127 by mechanical means (such as punching). This makes it possible to position the first and second lead-out members 126 and 127 properly relative to the rear end surface 2*r* of the heater body 2, thereby capable of making good electrical connections between the conductors 12 and 13 and the lead-out members 126 and 127 assuredly and reducing the risk of a short circuit upon contact between the first and second lead-out members 126 and 127. Such effects become more pronounced as the diameter of the heater body 2 decreases.

Although the invention has been described with reference to the specific embodiments thereof, the invention is not limited to the above-described embodiments. Various modification and variation of the embodiments described above will occur to those skilled in the art in light of the above teaching. The scope of the invention is defined with reference to the following claims.

What is claimed is:

1. A ceramic heater comprising:

a rod-shaped heater body having an insulating ceramic substrate, a heating resistor embedded in a front end portion of the ceramic substrate and an electric conductor embedded in the ceramic substrate with a front end portion thereof electrically connected to the heating resistor and a rear end portion thereof exposed at a rear end surface of the heater body; and a lead-out member having a front surface joined to part of the rear end surface of the heater body via a metallic layer so as to cover the exposed rear end portion of the electric conductor and to be kept from covering an outer circumferential surface of the heater body, wherein the metallic layer is made of a brazing material, and wherein the lead-out member is formed into a plate and has a low-expansion metal layer at least in part of a rear surface thereof while keeping the front surface of the lead-out member in contact with the metallic layer, and the low-expansion metal layer is made of a metal having a lower coefficient of linear expansion than the brazing material for the metallic layer.

2. A ceramic heater according to claim 1, wherein the lead-out member has a soft metal layer at least in the front surface thereof so that the low-expansion metal layer and the soft metal layer are clad with each other, and the soft metal layer is made of a metal softer than the metal of the low-expansion metal layer.

3. A ceramic heater according to claim 1, wherein the lead-out member is formed integrally with a lead to pass electric current through the lead-out member.

4. A glow plug comprising:

a ceramic heater provided with a rod-shaped heater body and a lead-out member, the heater body having an insulating ceramic substrate, a heating resistor embedded in a front end portion of the ceramic substrate and an electric conductor embedded in the ceramic substrate with a front end portion thereof electrically connected to the heating resistor and a rear end portion thereof exposed at a rear end surface of the heater body, the lead-out member having a front surface joined to part of the rear end surface of the heater body via a metallic layer so as to cover the exposed rear end portion of the electric conductor and to be kept from covering an outer circumferential surface of the heater body;

a metallic sleeve circumferentially surrounding the heater body with a front end portion of the heater body protruded from the metallic sleeve; and a metallic shell fitted onto a rear end portion of the metallic sleeve and having a mounting portion on an outer circumferential surface thereof so as to mount the glow plug in a cylinder head, wherein the rear end portion of the metallic sleeve is radially protruded with a clearance between an inner circumferential surface of the rear end portion of the metallic sleeve and the outer circumferential surface of the heater body.

5. A glow plug according to claim 4, wherein the clearance is larger than or equal to 0.1 mm.

6. A ceramic heater comprising:

a rod-shaped heater body having an insulating ceramic substrate, a heating resistor embedded in a front end portion of the ceramic substrate, and a pair of first and second electric conductors embedded in the ceramic substrate with front end portions thereof electrically connected to the heating resistor and rear end portions thereof exposed at a rear end surface of the heater body; and first and second lead-out members having front surfaces joined to parts of the rear end surface of the heater body via metallic layers so as to cover the exposed rear end portions of the first and second electric conductors, respectively, and to be kept from covering an outer circumferential surface of the heater body.

7. A ceramic heater according to claim 6, wherein the metallic layers are made of a brazing material.

8. A ceramic heater according to claim 7, wherein the first and second lead-out members are formed into plates and have low-expansion metal layers at least in parts of rear surfaces thereof while keeping the front surfaces of the first and second lead-out members in contact with the respective metallic layers, and the low-expansion metal layers are made of a metal having a lower coefficient of linear expansion than the brazing material for the metallic layers.

9. A ceramic heater according to claim 8, wherein the first and second lead-out members have soft metal layers at least in the front surfaces thereof so that the low-expansion metal layer and the soft metal layer are clad with each other, and the soft metal layers are made of a metal softer than the metal of the low-expansion metal layers.

10. A ceramic hater according to claim 6, wherein the first and second lead-out members are formed into one piece and separated from each other after joined to the rear end surface of the heater body.

11. A ceramic heater according to claim 6, wherein the first and second lead-out members are formed integrally with leads, respectively, to pass electric current through the first and second lead-out members.

12. A ceramic heater according to claim 6, the first and second lead-out members are positioned so as to provide a spacing of 0.1 mm or more between the first and second lead-out members.

13. A glow plug comprising:

a ceramic heater provided with a rod-shaped heater body and a pair of first and second lead-out members, the heater body having an insulating ceramic substrate, a heating resistor embedded in a front end portion of the ceramic substrate, and a pair of first and second electric conductors embedded in the ceramic substrate with front end portions thereof electrically connected to the heating resistor and rear end portions thereof exposed at a rear end surface of the heater body, the first and second lead-out members having front surfaces joined to parts of the rear end surface of the heater body via metallic layers so as to cover the exposed rear end portions of the first and second electric conductors, respectively, and to be kept from covering an outer circumferential surface of the heater body;

a metallic sleeve circumferentially surrounding the heater body with a front end portion of the heater body protruded from the metallic sleeve; and a metallic shell fitted onto a rear end portion of the metallic sleeve and having a mounting portion on an outer circumferential surface thereof so as to mount the glow plug in a cylinder head.

14. A glow plug according to claim 13, wherein the rear end portion of the metallic sleeve is radially protruded with a clearance between an inner circumferential surface of the rear end portion of the metallic sleeve and the outer circumferential surface of the heater body.

15. A glow plug according to claim 14, wherein the clearance is larger than or equal to 0.1 mm.

* * * * *